US012359666B2

(12) United States Patent
Li et al.

(10) Patent No.: US 12,359,666 B2
(45) Date of Patent: Jul. 15, 2025

(54) ROTOR ASSEMBLY AND COMPRESSOR

(71) Applicant: GUANGDONG MIDEA ENVIRONMENTAL TECHNOLOGY CO., LTD., Guangdong (CN)

(72) Inventors: Yang Li, Guangdong (CN); Zhenhao Li, Guangdong (CN)

(73) Assignee: GUANGDONG MIDEA ENVIRONMENTAL TECHNOLOGY CO., LTD., Guangdong (CN)

( * ) Notice: Subject to any disclaimer, the term of this patent is extended or adjusted under 35 U.S.C. 154(b) by 199 days.

(21) Appl. No.: 17/728,235

(22) Filed: Apr. 25, 2022

(65) Prior Publication Data

US 2023/0076531 A1 Mar. 9, 2023

Related U.S. Application Data

(63) Continuation of application No. PCT/CN2021/127944, filed on Nov. 1, 2021.

(30) Foreign Application Priority Data

Sep. 9, 2021 (CN) ..... 202111056348.9

(51) Int. Cl.
*F04C 29/02* (2006.01)
*F04C 18/02* (2006.01)
*F04C 29/00* (2006.01)

(52) U.S. Cl.
CPC ..... *F04C 29/028* (2013.01); *F04C 18/0215* (2013.01); *F04C 29/005* (2013.01); (Continued)

(58) Field of Classification Search
CPC .. F04C 29/028; F04C 29/026; F04C 18/0215; F04C 29/005; F04C 2240/807; F04C 2240/20
See application file for complete search history.

(56) References Cited

U.S. PATENT DOCUMENTS

2014/0037474 A1* 2/2014 Litsuka ..... F04C 2/025 417/410.5

FOREIGN PATENT DOCUMENTS

CN 202132239 U 2/2012
CN 103452852 A * 12/2013 ..... F04C 29/02
(Continued)

OTHER PUBLICATIONS

English translation of JP 2015166553 by PE2E Apr. 1, 2024.*
(Continued)

*Primary Examiner* — Deming Wan
(74) *Attorney, Agent, or Firm* — Scully, Scott, Murphy & Presser, P.C.

(57) ABSTRACT

A rotor assembly and a compressor are provided. The rotor assembly has a crankshaft, a rotor core, a balance weight and an oil baffle shield. The rotor core is provided with a vent hole. The vent hole extends through the rotor core along an axial direction of the rotor core. The balance weight is located at one end of the rotor core approximate to an oil sump of the compressor. The oil baffle shield is arranged to cover the balance weight and is provided with a central opening. The crankshaft extends through the central opening. An accommodating space is defined between the oil baffle shield and the rotor core. The accommodating space is communicated with the vent hole.

11 Claims, 7 Drawing Sheets

(52) U.S. Cl.
CPC .... *F04C 2240/20* (2013.01); *F04C 2240/805* (2013.01); *F04C 2240/807* (2013.01); *F04C 2240/809* (2013.01)

(56) References Cited

FOREIGN PATENT DOCUMENTS

| | | | | | |
|---|---|---|---|---|---|
| CN | 105485016 | A | | 4/2016 | |
| CN | 205377551 | U | | 7/2016 | |
| CN | 205858698 | U | | 1/2017 | |
| CN | 109555700 | A | * | 4/2019 | ..... F04C 18/0223 |
| CN | 210092975 | U | | 2/2020 | |
| CN | 113550908 | A | | 10/2021 | |
| JP | 2014070586 | A | | 4/2014 | |
| JP | 2015166553 | A | * | 9/2015 | ..... F04C 29/026 |
| JP | 2019190459 | A | | 10/2019 | |
| JP | 2021071058 | A | | 5/2021 | |
| KR | 20150051537 | A | * | 11/2013 | ..... F04C 29/028 |
| WO | 2019208079 | A1 | | 10/2019 | |
| WO | 2021085082 | A1 | | 5/2021 | |

OTHER PUBLICATIONS

English translaiton of KR201500515537 by PE2E Apr. 26, 2024.*
English translation of CN109555700 by PE2E (Dec. 18, 2024).*
English translaiton of CN103452852 by PE2E Mar. 6, 2025.*
Notice of Reasons for Refusal dated Oct. 24, 2023 received in Japanese Patent Application No. JP 2022-524033.
First Office Action dated Aug. 31, 2022 received in Chinese Patent Application No. CN 2021110563489.
Extended European Search report dated Dec. 9, 2022 received in European Patent Application No. EP 21893104.6.
Second Office Action dated Dec. 9, 2022 received in Chinese Patent Application No. CN 202111056348.9.
International Search Report dated Jan. 27, 2022 issued in PCT/CN2021/127944.
Written Opinion dated Jan. 27, 2022 issued in PCT/CN2021/127944.

* cited by examiner

ROTOR ASSEMBLY AND COMPRESSOR

CROSS-REFERENCE TO RELATED APPLICATIONS

The present application is a continuation application of PCT International Application No. PCT/CN2021/127944, filed on Nov. 1, 2021, which claims priority to and benefits of Chinese Application No. 202111056348.9, filed on Sep. 9, 2021 and entitled "ROTOR ASSEMBLY AND COMPRESSOR," the entire contents of which are incorporated herein by reference for all purposes. No new matter has been introduced.

FIELD

The present disclosure relates to the field of compression device technologies, and more particularly, to a rotor assembly and a compressor.

BACKGROUND

In the structure of a rotary compressor, a high-speed rotating airflow is formed when a balance weight is rotated, so that refrigerator oil droplets carried in a refrigerant are gradually deviated from an axial center of the compressor under a centrifugal action, and move towards a wall surface of a shell, thus achieving an effect of oil-gas separation. At present, the refrigerator oil tends to accumulate at a position close to an exhaust side of a stator to form a secondary source of oil droplets, resulting in a large discharge amount of oil and a lowered oil level in an oil sump.

SUMMARY

The present disclosure aims to solve at least one of the technical problems in the existing technology. Therefore, according to an aspect of the present disclosure, a rotor assembly is provided, which can reduce a discharge amount of refrigerator oil in the compressor.

The present disclosure further provides a compressor with the rotor assembly, according to another aspect thereof.

A rotor assembly according to an embodiment of a first aspect of the present disclosure includes a crankshaft, a rotor core, a balance weight and an oil baffle shield, the rotor core is provided with a vent hole, and the vent hole extends through the rotor core along an axial direction of the rotor core; the balance weight is located at one end of the rotor core close to an oil sump of the compressor; and the oil baffle shield is arranged to at least partially cover the balance weight, and provided with a central opening for the crankshaft to extend through, an accommodating space is defined between the oil baffle shield and the rotor core, and the accommodating space is communicated with the vent hole.

The rotor assembly according to the embodiment of the present disclosure at least has the following beneficial effects: rotation of the balance weight may cause gas in a rotation area of the balance weight to be pushed to the outside, and a local negative pressure is formed in the rotation area. When the balance weight is covered by the oil baffle shield, there is a local low pressure at the central opening of the oil baffle shield. And on an inner wall surface of the oil baffle shield, since a refrigerant cannot smoothly flow out, a local high pressure is formed close to a side wall due to a stagnation effect, which may push the refrigerant to flow from one side close to the oil baffle shield to one side away from the oil baffle shield through the vent hole, thus achieving an effect of increasing a flow rate of the vent flow. When a rotor is in a high-speed rotating state, and oil droplets carried in the refrigerant may be separated during a process of passing through the vent hole, and thrown to the outside of the rotor in a concentrated way at an outlet of the vent hole. Then the oil droplets dropped back to the oil sump from an air gap between an outer edge of the stator and an inner wall surface of a shell, thus reducing a discharge amount of oil.

According to some embodiments of the present disclosure, the oil baffle shield includes an oil baffle portion and a mounting portion, the oil baffle portion is in an annular shape. The mounting portion is arranged at one end of the oil baffle portion away from the rotor core, and the mounting portion is connected to the balance weight.

According to some embodiments of the present disclosure, a minimum axial clearance between the oil baffle portion and the rotor core is no more than 0.5 mm.

According to some embodiments of the present disclosure, a minimum axial clearance between the oil baffle portion and the rotor core is no more than 0.1 mm.

According to some embodiments of the present disclosure, the mounting portion is fixed to the balance weight by bonding or a screw.

According to some embodiments of the present disclosure, a diameter of a maximum inscribed circle of the vent hole is no less than 3 mm.

According to some embodiments of the present disclosure, the rotor core is provided with a plurality of vent holes, and the plurality of vent holes are evenly distributed along a circumferential direction of the rotor core.

According to some embodiments of the present disclosure, a rotation diameter of an inner edge of the vent hole is d, a diameter of the central opening is e, a diameter of a part of the crankshaft corresponding to the mounting portion is f, $e \geq d$, and $e \geq f+4$.

According to some embodiments of the present disclosure, a minimum turning diameter of the balance weight is D, a diameter of the central opening is e, and $e \leq D$.

A compressor according to an embodiment of a second aspect of the present disclosure includes the rotor assembly according to the embodiment of the first aspect of the present disclosure.

The compressor according to the embodiment of the present disclosure at least has the following beneficial effects: by adopting the rotor assembly of the embodiment according to the first aspect of the present disclosure, the flow rate of the vent hole can be increased, thus improving the oil return capacity of the air gap between the outer edge of the stator and the inner wall surface of the shell.

Additional aspects and advantages of the present disclosure will be explained in part in the following description, which can become apparent from the following description or be understood through practice of the present disclosure.

BRIEF DESCRIPTION OF DRAWINGS

The present disclosure is further described hereinafter with reference to the drawings and the embodiments, where.

Figure 1:
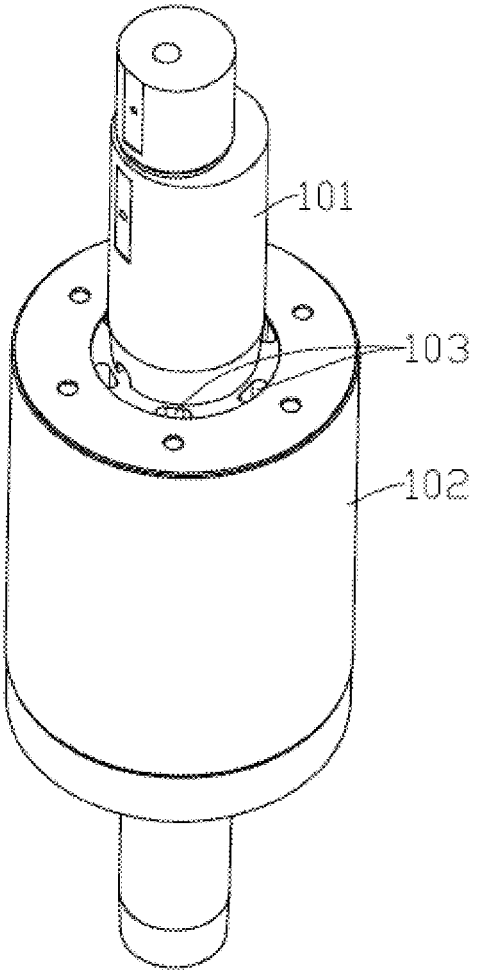
FIG. 1 is a schematic diagram of a rotor assembly according to an embodiment of the present disclosure.

Reference numerals shown in the figures are described as follows:

101: crankshaft; 102: rotor core; 103: vent hole;

301: balance weight; 302: oil baffle shield; 303: central opening; 304: oil baffle portion; 305: mounting portion; 306: screw; 307: accommodating space;

401: mounting hole;

501: maximum inscribed circle;

801: cylinder; 802: upper cover; 803: lower cover; 804: oil sump; 805: fixed scroll plate; 806: movable scroll plate; 807: main frame; 808: stator assembly; 809: sub-frame.

DETAILED DESCRIPTION OF EMBODIMENTS

Embodiments of the present disclosure are described below in detail, illustrations of which are shown in the accompanying drawings, where identical or similar reference numerals denote identical or similar elements or elements having the same or similar functions. The embodiments described below by reference to the accompanying drawings are exemplary and are intended only to explain the present disclosure and are not to be construed as limiting the present disclosure.

In the description of the present disclosure, it should be understood that any orientation/position related description, such as the orientational or positional relationship, such as, up, down, front, rear, left, right, and the like, is based on the orientational or positional relationship shown in the accompanying drawings, is only for the purpose of facilitating the description of the present disclosure and simplifying the description, and does not indicate or imply that the device or element must have a specific orientation or position, be constructed and operated in a specific orientation or position, and therefore shall not be understood as a limitation to the present disclosure.

In the description of the present disclosure, several means one or more, a plurality of means more than two, greater than, less than, more than, and the like are understood as not including this number, while above, below, within, and the like are understood as including this number. If there are the descriptions of first and second, it is only for the purpose of distinguishing technical features, and shall not be understood as indicating or implying relative importance, implicitly indicating the number of the indicated technical features or implicitly indicating the order of the indicated technical features.

In the description of the present disclosure, words such as setup, installation, and connection shall be understood in a broad sense unless otherwise expressly limited, and a person skilled in the art may reasonably determine the specific meaning of the above words in the present disclosure with reference to the context of the technical scheme.

At present, in a structure of a rotary compressor, the compressor includes a shell, a motor and a compression structure. An internal cavity is formed in the closed shell, the motor and the compression structure are both arranged in the cavity and connected by a crankshaft, and the compression structure is driven by the crankshaft to compress a refrigerant during operation of the motor.

The motor includes a stator, a rotor, and assemblies of the stator and the rotor. The cavity is generally divided into three parts by the motor, which are namely a motor lower cavity, a motor cavity and a motor upper cavity. In most cases, the refrigerant compressed to a high pressure needs to pass through the motor cavity to enter a discharge port of the compressor, and then enter an air conditioning system.

As a core component of the compressor, the motor provides rotary power for the compressor, and a performance of the motor directly affects a performance of the compressor. The compressor includes the motor and a compression structure located at one axial end of the motor, and a refrigerant in a high-pressure cavity in the compression structure and the refrigerator oil inside the compressor may flow through the motor.

When the rotor in the motor is rotated at a high speed relative to the stator, an oil-gas mixture of the refrigerant and the oil at one end of the compression structure may flow to an axial end surface of the rotor. Meanwhile, under an action of a centrifugal force generated during high-speed rotation of the rotor, the oil-gas mixture may be thrown to the shell of the compressor, and then discharged to the outside through an exhaust port on the shell, thus affecting a discharge amount of oil of the compressor.

The rotor of the motor is in a high-speed rotating state when the compressor is operated. At least one of two axial ends of the rotor is provided with a balance weight, and the balance weight generally has an irregular shape. An example of arranging one balance weight at each of two axial ends of the rotor is taken for description below.

The compression structure compresses a low-temperature refrigerant into a high-pressure oil-gas mixture and discharges the high-pressure oil-gas mixture into the shell, and the high-pressure oil-gas mixture in the shell flows through an airflow central opening on the rotor and then reaches an exhaust pipe. When the rotor drives the balance weights at upper and lower ends of the rotor to return, the balance weights may stir an airflow in the shell, and a high-speed rotating airflow is formed when the balance weights are rotating, so that oil droplets carried in the refrigerant are gradually deviated from an axial center of the compressor under a centrifugal action, and move towards a side wall surface of the shell, thus achieving an effect of oil-gas separation.

However, a low-pressure area is formed at a leeward end of the upper balance weight, and a high-pressure area is formed at a windward end of the lower balance weight. Therefore, a flow rate of the refrigerant at the airflow central openings close to the low-pressure area of the upper balance weight and the high-pressure area of the lower balance weight is very large, which causes discharge of a large amount of oil carried in the refrigerant, resulting in a sharply increased discharge rate of oil, a chaotic flow field and a low energy efficiency of the compressor.

In addition, the oil of the compressor may be scattered everywhere in the compressor under a carrying action of the refrigerant, and whether the oil may rapidly return to the oil sump to ensure a certain operating oil level is an important guarantee for reliable lubrication and normal operation of the compressor.

Under a centrifugal action, the oil tends to aggregate close to an inner wall surface of the shell. A main channel for the oil to return to the oil sump is an air gap formed between an outer edge of the stator of the motor and the inner wall surface of the shell, and the oil sump of the compressor is located at the bottom of the shell. In order to ensure that the oil drops back to the oil sump through the air gap, it is generally expected that a flowing direction of the refrigerant in the air gap is the same as an oil return direction, thus promoting the oil return.

Otherwise, the oil is easy to accumulate at a position close to an exhaust side of the stator to form a secondary source of oil droplets, resulting in a large discharge amount of oil and a lowered oil level in the oil sump. Therefore, it is necessary to adjust a circulation capability of the refrigerant by lower and upper pressure characteristics of the rotor of the motor, so as to improve a fluidity of the oil at the air gap, thus improving the oil return efficiency.

Figure 2:
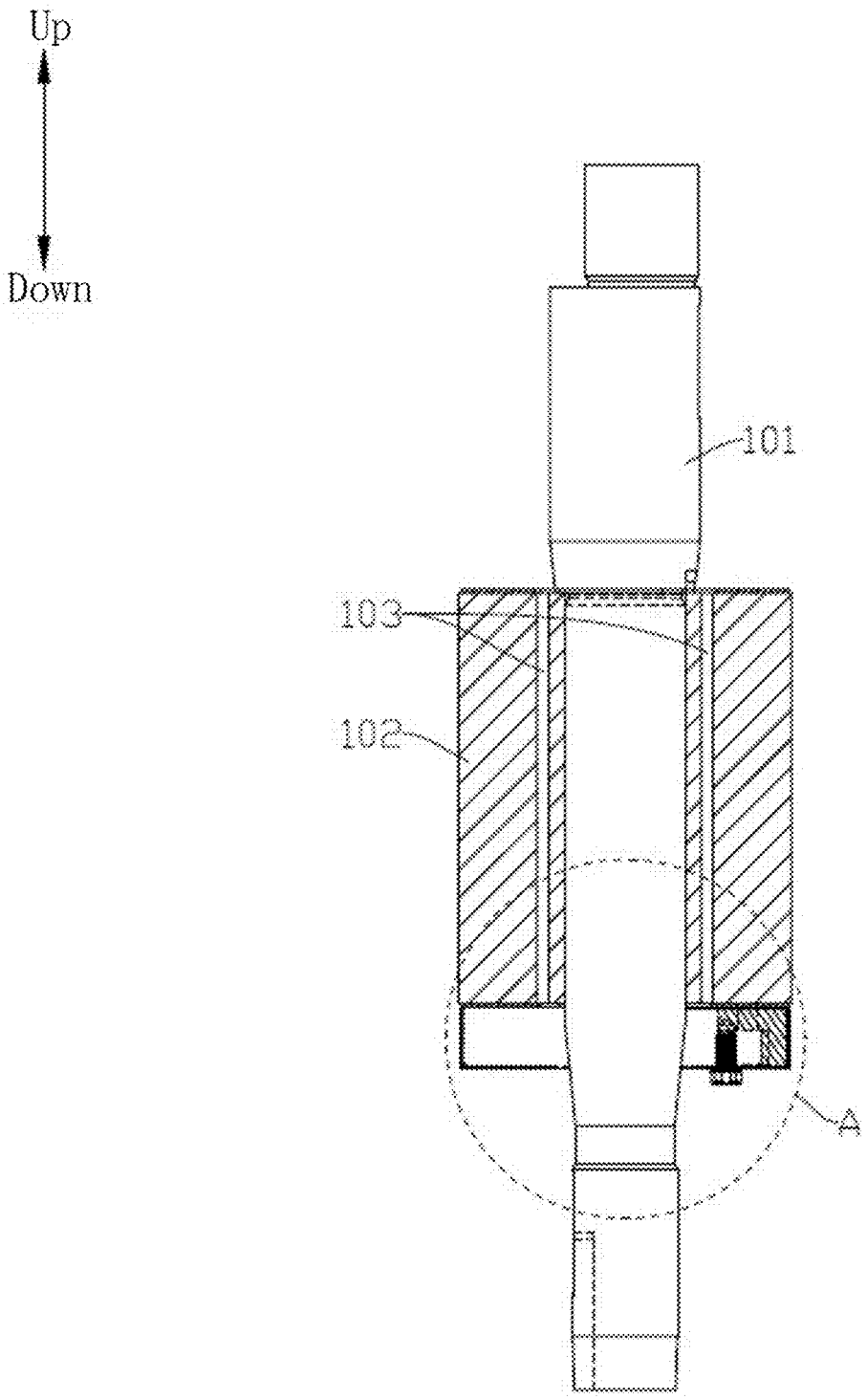
FIG. 2 is front cross-sectional view of the rotor assembly shown in FIG. 1.
Figure 3:
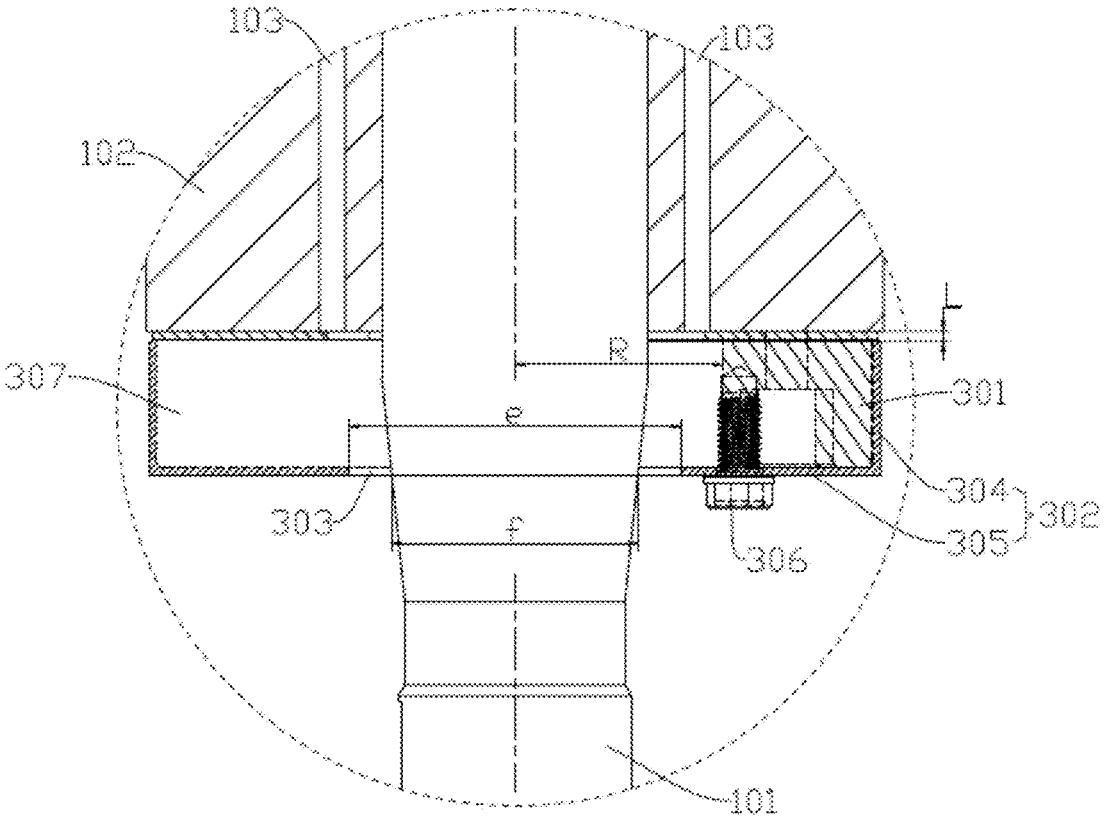
FIG. 3 is an enlarged view of a part A shown in FIG. 2.

With reference to FIG. 1 to FIG. 3, it may be understood that the rotor assembly according to the embodiment of the present disclosure includes a crankshaft 101, a rotor core 102, a balance weight 301 and an oil baffle shield 302. The crankshaft 101 extends or penetrates through the rotor core 102, and the balance weight 301 is mounted at a lower end of the rotor core 102, which means that the balance weight 301 is located at one end of the rotor core 102 close to an oil sump 804 (referring to FIG. 8). The oil baffle shield 302 is mounted on the balance weight 301, the oil baffle shield 302 is covered on the balance weight 301. The oil baffle shield 302 is also provided with a central opening 303, and the crankshaft 101 extends or penetrates through the central opening 303. The rotor core 102 is provided with a vent hole 103 extending or penetrating through the rotor core 102, and an axial direction of the vent hole 103 is parallel to an axial direction of the rotor core 102, which means that the vent hole 103 extends or penetrates through the rotor core 102 along the axial direction of the rotor core 102. Moreover, an accommodating space 307 is defined between the oil baffle shield 302 and the rotor core 102, and the accommodating space 307 is communicated with the vent hole 103, so that the oil can enter the vent hole 103 from the accommodating space 307, and be discharged through the vent hole 103.

It should be noted that the oil baffle shield 302 may also be mounted on the crankshaft 101, as long as it is ensured that the balance weight 301 is wrapped, and it is ensured that a high pressure is formed on an inner wall surface of the oil baffle shield 302.

It may be understood that rotation of the balance weight 301 may cause gas in a rotation area of the balance weight to be pushed to the outside, and a local negative pressure is formed in the rotation area. Therefore, there are local negative pressures on both upper and lower sides of the rotor. When the negative pressure on one side is lower, and a pressure difference is formed, the refrigerant may flow from a high-pressure side to a low-pressure side, and the larger the pressure difference is, the larger the flow rate is.

Figure 6:
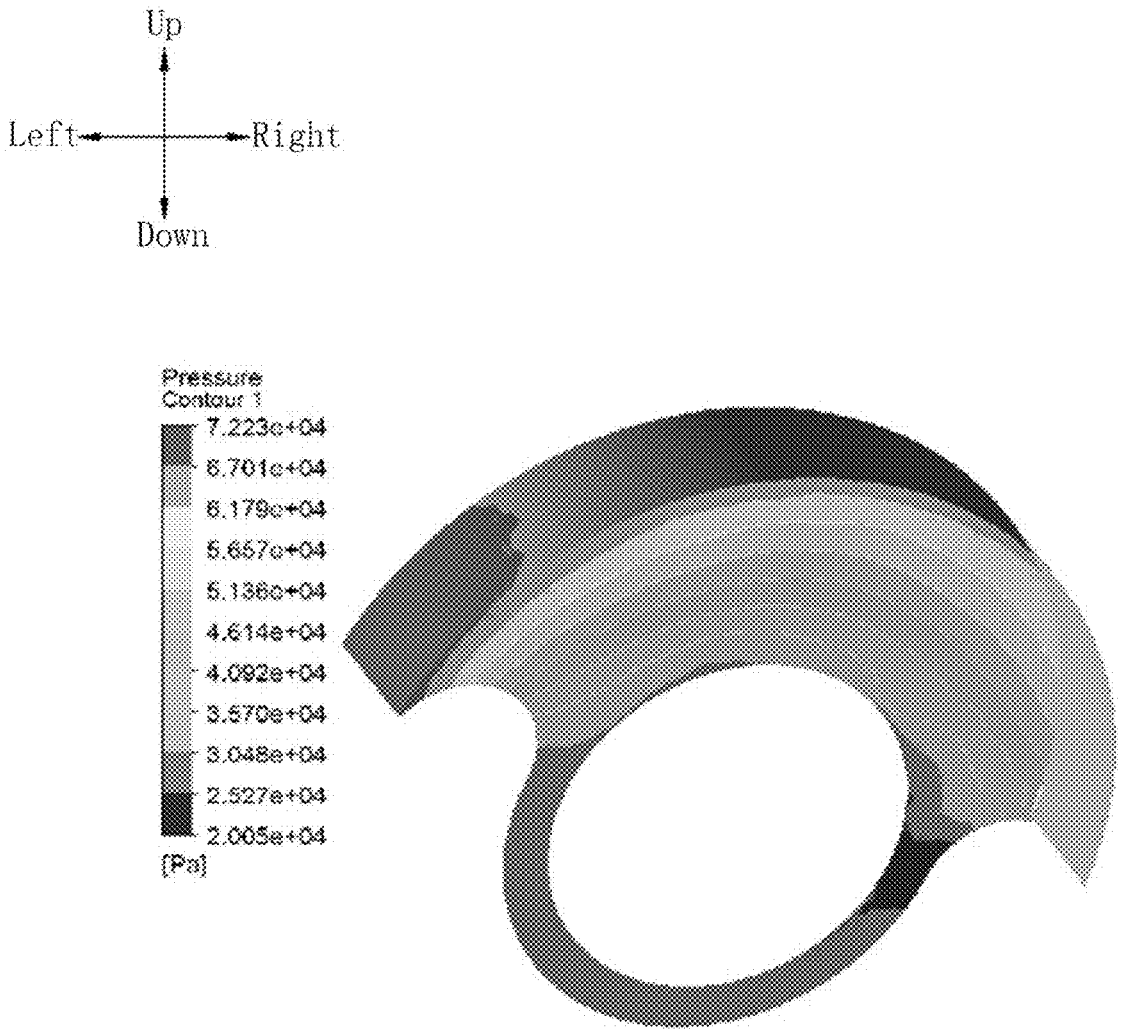
FIG. 6 is a pressure distribution chart inside the oil baffle shield.

With reference to FIG. 6, it may be understood that since another part of the oil baffle shield 302 is contacted with the balance weight 301, it can be considered that this part of area contacted with the balance weight 301 is not affected by an airflow, so that pressure distribution inside the oil baffle shield 302 is only analyzed for this part of area not contacted with the balance weight 301.

With reference to FIG. 6, it may be understood that inside the oil baffle shield 302, a pressure near a side wall surface of the oil baffle shield 302 is high, but a pressure on a central part of the oil baffle shield 302 is low. It is this pressure distribution characteristic that can provide a high pressure for a bottom inlet of the vent hole 103 of the rotor core 102, so that the refrigerant flows upwardly from a lower end of the vent hole 103.

With reference to FIG. 6, it may be understood that in an upper left corner area in the drawing, a darker-color position is a position corresponding to a windward side of the balance weight 301, where the airflow impacts a head of the balance weight 301, which causes stagnation of the airflow, thus generating a high pressure. With reference to FIG. 6, a pressure at this position ranges from 6.701 e04 Pa to 7.223 e04 Pa, which is ranged between 67,010 Pa and 72,230 Pa.

With reference to FIG. 6, it may be understood that in a lower right corner area in the drawing, a darker-color position is a position corresponding to a leeward side of the balance weight 301, that is, the position where lower and smaller arc part joins the upper and larger arc part, and the balance weight 301 is rotated to form a relatively increased space at the position of the leeward side, thus generating a low pressure. With reference to FIG. 6, a pressure at this position ranges from 2.005 e4 Pa to 2.527 e4 Pa, which is ranged between 20,050 Pa and 25,270 Pa.

It may be understood that, for the rotor assembly according to the embodiment of the present disclosure, the oil baffle shield 302 covers the balance weight 301, and there is a local low pressure at a central position of the oil baffle shield 302, which means that a local low pressure is formed at the central opening 303. However, an inner wall surface of the oil baffle shield 302 baffles the refrigerant, so that the refrigerant cannot smoothly flow out. A local high pressure is formed close to a side wall due to a stagnation effect, which may push the refrigerant to flow from one side with the oil baffle shield 302 to one side without the oil baffle shield 302, which means to push the refrigerant to flow from one side close to the oil baffle shield 302 to one side away from the oil baffle shield 302 through the vent hole 103, thus achieving an effect of increasing a flow rate of the refrigerant.

However, a rotor is in a high-speed rotating state, and oil droplets carried in the refrigerant may be separated during a process of passing through the vent hole 103, and thrown to the outside of the rotor collectively at an outlet of the vent hole 103, which means that the oil droplets flow along an radial direction of the rotor core 102 from one side of the vent hole 103 away from the oil baffle shield under an action of centrifugal force, thus reducing a discharge amount of oil.

Moreover, since the flow rate of the refrigerant is increased, the oil may be driven to flow back to the oil sump 804 along the air gap formed between the outer edge of the stator and the inner wall surface of the shell, thus promoting the oil return.

For the rotor assembly according to an embodiment of the present disclosure, the vent holes 103 are arranged in the rotor core 102, in the way of the vent holes 103 penetrating through the rotor core 102 along an axial direction of the rotor core 102, and the oil baffle shield 302 covering, at least partially, the balance weight 301 is additionally arranged on the balance weight 301, so that the flow rate of the refrigerant of the vent hole 103 is increased by utilizing an low and upper pressure difference characteristic of the rotor, thus improving the oil return capacity of a trimming of the stator (the air gap between the outer edge of the stator and the inner wall surface of the shell), and reducing the discharge amount of oil.

With reference to Table 1, Table 1 shows an improvement effect of a throughput of the motor. Effects of a scheme before improvement, a scheme of separately adding the oil baffle shield 302, and a scheme of adding a combination of the oil baffle shield 302 and the vent hole 103 of the rotor are compared through tests, and reference is made by a parameter index of through-flow ratio. A physical meaning of the through-flow ratio refers to a mass percentage of an exhaust amount of the refrigerant passing through the stator and the vent hole 103 of the rotor to a total exhaust amount of the compressor.

TABLE 1

| Improvement effect of throughput of motor | |
|---|---|
| Scheme | Through-flow ratio (%) |
| Before improvement | 19.2 |
| Separate addition of oil baffle shield | 4.6 |
| Addition of combination of oil baffle shield and vent hole of rotor | 67.2 |

With reference to Table 1, it may be understood that the through-flow ratio before improvement is 19.2%, the through-flow ratio of separately adding the oil baffle shield 302 is 4.6%, and the through-flow ratio of adding the combination of the oil baffle shield 302 and the vent hole 103 of the rotor is 67.2%. When only the oil baffle shield 302 is added, but no vent hole 103 is formed in the rotor core 102, the refrigerant cannot be pushed to flow from one side of the rotor core 102 close to the oil baffle shield 302 to one side of the rotor core away from the oil baffle shield 302. Instead, the refrigerant is retained in the oil baffle shield 302, which reduces the flow rate of the refrigerant, so that the through-flow ratio of the scheme of separately adding the oil baffle shield 302 is reduced compared with that of the scheme before improvement.

However, for the scheme of adding the combination of the oil baffle shield 302 and the vent hole 103 of the rotor, the refrigerant is baffled by the inner wall surface of the oil baffle shield 302, so that the refrigerant cannot smoothly flow out. The local high pressure is formed close to the side wall due to the stagnation effect, and in addition, the rotor core 102 is provided with the vent hole 103 penetrating through the rotor core 102 along the axial direction of the rotor core 102, so that the refrigerant is guided to flow from one side with the oil baffle shield 302 to one side without the oil baffle shield 302 through the vent hole 103, which means to push the refrigerant to flow from one side close to the oil baffle shield 302 to one side away from the oil baffle shield 302 through the vent hole 103, thus achieving the effect of increasing the flow rate of the refrigerant.

Since the flow rate of the refrigerant is increased, the refrigerant may more easily drive the oil to flow back to the oil sump 804 along the air gap formed between the outer edge of the stator and the inner wall surface of the shell, thus promoting the oil return.

TABLE 2

| Improvement effect of discharge amount of oil | | |
|---|---|---|
| | Actual measured discharge amount of oil (%) | |
| Model | Before improvement | After improvement |
| Model 1 | 4.7 | 3.2 |
| Model 2 | 5.6 | 3.3 |
| Model 3 | 5.0 | 3.0 |

With reference to Table 2, Table 2 shows improvement effects of discharge amounts of oil of three different models. More particularly, actually measured discharge amounts of oil of model 1, model 2 and model 3 before and after improvement are respectively compared in tests. These three models are scroll compressors with a high back pressure but different discharge amounts. A scheme after improvement is the rotor assembly according to the embodiment of the present disclosure, and the rotor assembly includes the rotor core 102 with the vent hole 103 and the oil baffle shield 302 arranged on the balance weight 301.

With reference to Table 2, it may be understood that the measured discharge amount of oil of model 1 before improvement is 4.7%, and the measured discharge amount of oil after improvement is 3.2%, so that the discharge amount of oil is reduced by 1.5%. The measured discharge amount of oil of model 2 before improvement is 5.6%, and the measured discharge amount of oil after improvement is 3.3%, so that the discharge amount of oil is reduced by 2.3%. The measured discharge amount of oil of model 3 before improvement is 5.0%, and the measured discharge amount of oil after improvement is 3.0%, so that the discharge amount of oil is reduced by 2%.

It can be seen from the above analysis that although different models have different reduced ranges in discharge amount of oil after improvement, there are obvious improvement effects, that is to say, the rotor assembly according to the embodiment of the present disclosure significantly reduces the discharge amount of oil, thus significantly improving the energy efficiency.

With reference to FIG. 2 and FIG. 3, it may be understood that the oil baffle shield 302 includes an oil baffle portion 304 and a mounting portion 305. The mounting portion 305 is located between the rotor and the oil sump 804 of the compressor, which means that the mounting portion 305 is located at one end of the balance weight 301 close to the oil sump 804, which also means that the mounting portion 305 is located at one end of the balance weight 301 away from the rotor core 102. It may be understood that the mounting portion 305 can reduce an airflow flowing out through the central opening 303 of the oil baffle shield 302, so that an effect of forming the high pressure on the inner wall surface of the oil baffle shield 302 is ensured, thus increasing a throughput of the motor.

With reference to FIG. 3, it may be understood that the oil baffle portion 304 is in an annular shape, and located on an outer peripheral side of the balance weight 301, which baffles the escape of the oil from an area surrounded by the oil baffle shield 302 at the outer peripheral side of the balance weight 301. The mounting portion 305 is arranged at a lower edge of the oil baffle portion 304, and the mounting portion 305 is connected to the balance weight 301.

Figure 4:
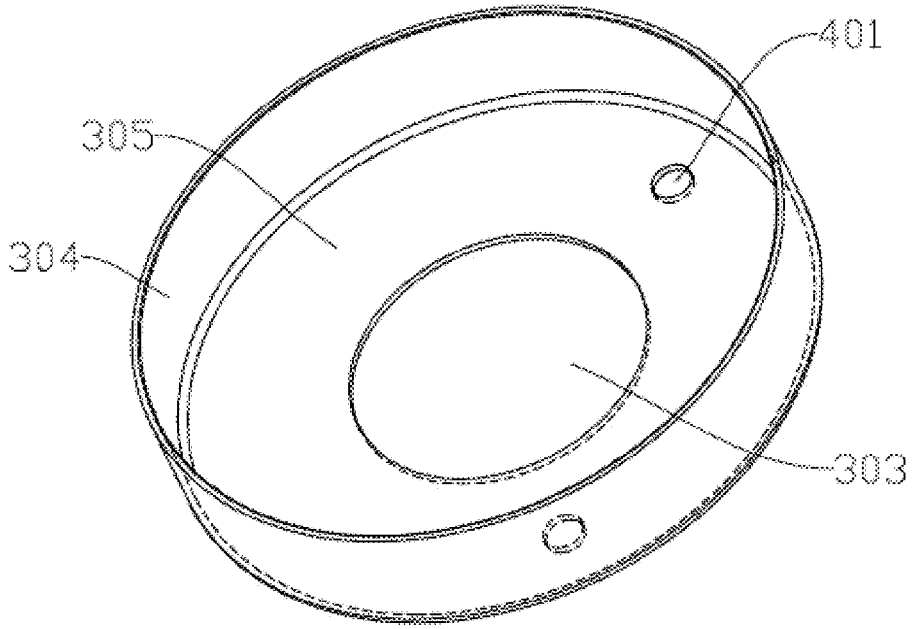
FIG. 4 is a schematic structural diagram of an oil baffle shield shown in FIG. 3.

With reference to FIG. 3 and FIG. 4, it may be understood that the mounting portion 305 is provided with a mounting hole 401, and fixed on the balance weight 301 by a screw 306, which means that the screw 306 penetrates through the mounting hole 401, and then threadedly connected to the balance weight 301. Quick assembly and disassembly may be realized via mounting by the screw 306, so that it is convenient for cleaning the oil baffle shield 302 or replacing the oil baffle shield 302.

With reference to FIG. 3, it may be understood that the mounting portion 305 and the oil baffle portion 304 may form an angle close to vertical, which may be understood that the mounting portion 305 bends from one end of the oil baffle portion 304 away from the rotor core 102 towards the central part of the rotor core 102, which also means that the oil baffle portion 304 extends to an end surface of the balance weight 301, while the mounting portion 305 extends along the radial direction of the rotor core 102 towards the axial direction of the rotor core 102. The mounting portion 305 is provided with the mounting hole 405, and fixed on the end surface of the balance weight 301 by the screw 306.

In addition, it should be noted that the mounting portion 305 may also be fixed on the balance weight 301 by bonding, which means that the mounting portion 305 is bonded to the balance weight 301. Certainly, the oil baffle portion 304 attached to the balance weight 301 may also be bonded to the balance weight 301, or the mounting portion 305 and the oil baffle portion 304 are both bonded to the balance weight 301.

The oil baffle portion 304 is located at one end of the mounting portion 305 away from an axis of the rotor core 102, and the oil baffle portion 304 extends towards a side surface of the balance weight 301, and is attached to the side surface of the balance weight 301. The oil baffle portion 304 is arranged to baffle the refrigerant, so that the refrigerant cannot smoothly flow out. The local high pressure is formed close to the side wall due to the stagnation effect, which may push the refrigerant to flow from one side with the oil baffle shield 302 to one side without the oil baffle shield 302, which means to push the refrigerant to flow from one side close to the oil baffle shield 302 to one side away from the oil baffle shield through the vent hole 103, thus achieving the effect of increasing the flow rate of the refrigerant.

With reference to FIG. 3, it may be understood that in the axial direction of the rotor core 102, a minimum distance between the oil baffle portion 304 and the rotor core 102 is L. According to the technical principle, there is the high pressure on the side wall surface of the oil baffle shield 302. If an assembly clearance is too large, which means that the minimum distance L between the oil baffle portion 304 and the rotor core 102 is too large, a local leakage amount will be increased, there will be a high-speed airflow flowing outwardly, which may impact the airflow at the lower part of the motor, finally resulting in unstable oil level and deteriorated oil discharge. Therefore, it is of great significance to reasonably set the minimum distance L between the oil baffle portion 304 and the rotor core 102 to maintain oil level stability and reduce oil discharge deterioration.

Figure 7:
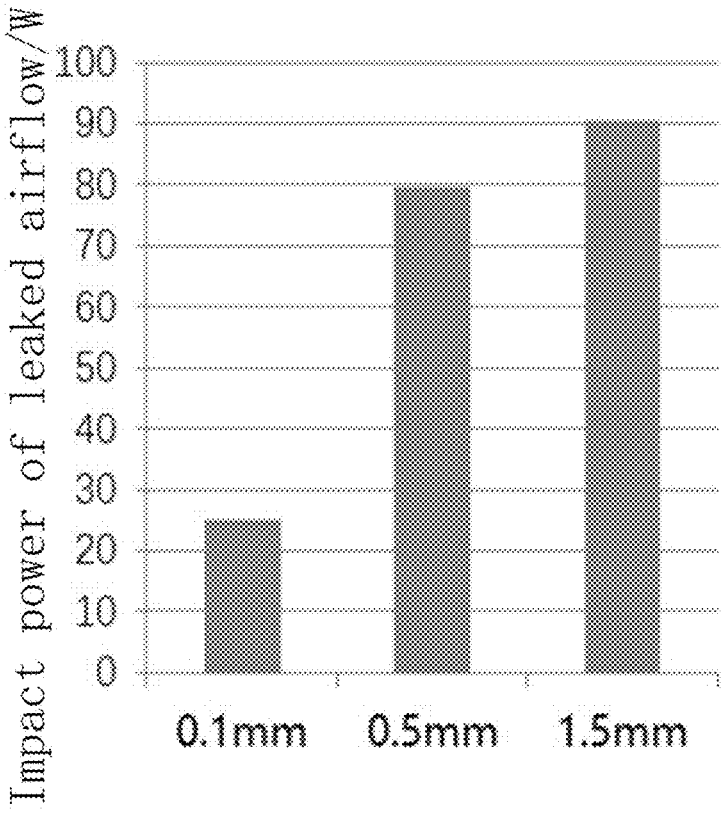
FIG. 7 is a diagram showing the relationship between impact energy and an axial assembly clearance of the oil baffle shield.

With reference to FIG. 7, it may be understood that FIG. 7 shows different minimum distances L between the oil baffle portion 304 and the rotor core 102 and simulation results of corresponding impact powers of leaked airflow. The abscissa shows different axial assembly clearances, which are namely the minimum distances L between the oil baffle portion 304 and the rotor core 102 in the axial direction of the rotor core 102. The ordinate shows the impact powers of leaked airflow, and the histogram shows impact energies (powers) of leaked airflow under the three axial assembly clearances.

With reference to FIG. 7, it may be understood that when the minimum distance L between the oil baffle portion 304 and the rotor core 102 is 0.1 mm, the impact power of leaked airflow is 25 W, when the minimum distance L between the oil baffle portion 304 and the rotor core 102 is 0.5 mm, the impact power of leaked airflow is 79 W, and when the minimum distance L between the oil baffle portion 304 and the rotor core 102 is 1.5 mm, the impact power of leaked airflow is 90 W.

It may be understood that in some embodiments, the minimum axial clearance between the oil baffle portion 304 and the rotor core 102 is set to be no more than 0.5 mm, which means that if the minimum distance L between the oil baffle portion 304 and the rotor core 102 is set to be less than or equal to 0.5 mm, it may improve local leakage, and reduce the high-speed airflow flowing outwardly, thus reducing the impact on the airflow at the lower portion of the motor, and maintaining the oil level stability and reducing the oil discharge deterioration.

It may be understood that in some embodiments, the minimum axial clearance between the oil baffle portion 304 and the rotor core 102 is set to be no more than 0.1 mm, which means that the minimum distance L between the oil baffle portion 304 and the rotor core 102 is set to be less than or equal to 0.1 mm, which can obviously improve local leakage, and obviously reduce the high-speed airflow flowing outwardly, thus reducing the impact on the airflow at the lower portion of the motor, and maintaining the oil level stability and reducing the oil discharge deterioration. Therefore, the leakage may be basically ensured to be acceptable.

Figure 5:
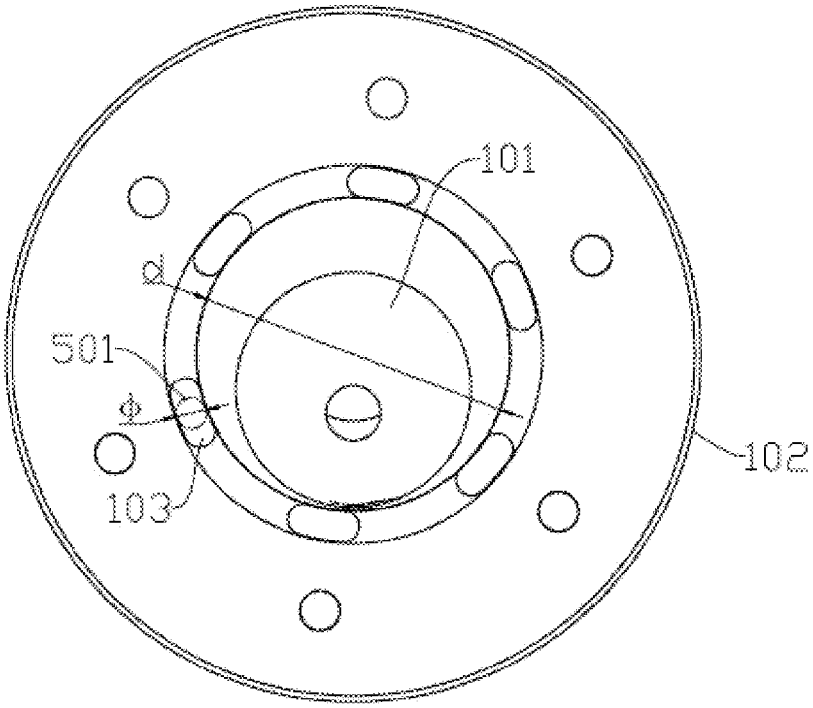
FIG. 5 is a top view of the rotor assembly shown in FIG. 1.

With reference to FIG. 5, it may be understood that in a cross section of the vent hole 103, the vent hole 103 is in a curved strip-hole shape, which means that a long edge of the vent hole 103 is in an arc shape, a circle center of the arc coincides with a circle center of the rotor core 102, and end portions of two long edges are connected by short edges in a semicircle shape, thus forming the closed vent hole 103 composed of arc lines. A maximum inscribed circle 501 can be drawn in the vent hole 103, and a diameter of the maximum inscribed circle 501 is cp. According to multiple tests, when the diameter φ of the maximum inscribed circle 501 is no less than 3 mm, which means that φ is greater than or equal to 3 mm, the refrigerant and the oil flow out smoothly. However, if the diameter φ of the maximum inscribed circle 501 is less than 3 mm, a channel is easy to be blocked by the oil, which reduces a circulation capacity of the refrigerant.

It should be noted that the vent hole 103 may also be in other shapes, such as a waist-shaped hole (the waist-shaped hole is also called an oblong hole, and the waist-shaped hole is composed of semi-circular arcs at two ends and parallel planes in the middle, with the diameter φ of the maximum inscribed circle 501 equal to the diameter of the semi-circular arcs), a circular hole (with the diameter φ of the maximum inscribed circle 501 equal to a diameter of the circular hole) and a square hole (with the diameter φ of the maximum inscribed circle 501 equal to a length of a shortest edge of the square hole), or an irregularly-shaped hole.

With reference to FIG. 5, it may be understood that the rotor core 102 is provided with a plurality of vent holes 103, which means that at least two vent holes 103 of the rotor core 102 are provided, and the plurality of vent holes 103 are evenly distributed along a circumferential direction of the rotor core 102. The premise of promoting increase of the ventilation flow rate of the refrigerant at the vent hole by a pressure difference between upper and lower end surfaces of the rotor core 102 is that the rotor is provided with the vent hole 103 penetrating through in an axial direction. The flow rate of the vent refrigerant at the vent hole can be increased by arranging the plurality of vent holes 103. Moreover, even distribution of the plurality of vent holes 103 along the circumferential direction of the rotor core 102 may make an acting force of the refrigerant on the rotor core 102 more uniform, thus reducing an eccentric force caused by uneven distribution of the vent holes 103.

For example, with reference to FIG. 5, six vent holes 103 are evenly distributed on the rotor core 102. The pressure difference between the upper and lower end surfaces of the rotor core 102 promotes the vent refrigerant to flow out from the six vent holes 103, which increases the flow rate of the vent refrigerant. Moreover, the six vent holes 103 are evenly distributed along the circumferential direction of the rotor core 102, such that the flow rate of the vent refrigerant out from the six vent holes 103 is relatively uniform, which makes the rotor core 102 uniformly stressed in the circumferential direction and reduces the generation of the eccentric force.

It should be noted that the rotor core 102 may also be provided with other numbers of vent holes 103, for example, two, three, four or more than five, and the above drawings are only for illustration, not as a limitation of the embodiments of the present disclosure.

With reference to FIG. 5, it may be understood that when the rotor core 102 rotates, an inner edge and an outer edge of the vent hole 103 respectively form two revolving tracks, where a diameter of the revolving track formed by the inner edge of the vent hole 103 is d.

With reference to FIG. 3, it may be understood that the mounting portion 305 of the oil baffle shield 302 is horizontally arranged, which may be understood that if the mounting portion 305 is located in a reference plane, the reference plane intersects with the crankshaft 101, and a cross section formed by the intersection is a cross section of the crankshaft 101 in the reference plane, and a diameter of the crankshaft 101 in the cross section at this position is f.

It should be noted that in an actual product, the mounting portion 305 has a certain thickness. When a conical section of the crankshaft 101 intersects with the above-mentioned reference plane, the reference plane refers to a plane where a middle position of the mounting portion 305 is located, that is, a plane where a middle position of an upper plane and a lower plane of the mounting portion 305 is located.

With reference to FIG. 3, it may be understood that a diameter of the central opening 303 of the oil baffle shield 302 is e, and the central opening 303 is defined by the mounting portion 305, or it may be understood that the central opening 303 is arranged on the mounting portion 305. Then, the position of the central opening 303 is corresponding to the position of the crankshaft 101, and a difference between the diameter e of the central opening 303 and the diameter f of the crankshaft 101 is greater than or equal to 4 (mm), that is, $e \geq f+4$ (mm). In addition, with reference to FIG. 3 and FIG. 5, it may be understood that the diameter e of the central opening 303 is greater than or equal to d, i.e., $e \geq d$.

By setting $e \geq f+4$ (mm), there is enough space between the crankshaft 101 and the oil baffle shield 302 to allow enough refrigerant to enter the space enclosed by the oil baffle shield 302, that is, the diameter of the central opening 303 is set to be large enough to allow refrigerant to enter from the central opening 303, thus reducing the obstruction of the oil baffle shield 302 to the direction in which a refrigerant enters. Therefore, $e \geq f+4$ (mm) limits that a gap between the central opening 303 of the oil baffle shield 302 and the annular channel formed by the crankshaft 101 is no less than 4 mm, which guarantees a through-flow capacity thereof and reduces the resistance.

By setting $e \geq d$, the oil baffle shield 302 may reduce the obstruction of the vent hole 103, so that part of the refrigerant may directly enter the vent hole 103 from the central opening 303, and then directly enter the vent holes 103 under the action of the pressure difference between the upper and lower sides of the rotor core 102, and then be discharged from the upper end of the vent hole 103, so that the air flow does not need to be blown to the side wall of the oil baffle shield 302, the movement distance is reduced, and the discharge efficiency of the refrigerant is improved. Therefore, $e \geq d$ is to ensure that the channel between the central opening 303 in the oil baffle shield 302 and the crankshaft 101 can overlap with an axial projection plane of the vent hole 103. If there is no overlap, a flow path of the air flow into the rotor core 102 will increase and the ventilation flow of the rotor core 102 will decrease.

With reference to FIG. 3, it may be understood that if a minimum rotation radius of the balance weight 301 is R, then a minimum slewing diameter of the balance weight 301 is D, which is equal to 2R, and the diameter e of the central opening 303 and the minimum slewing diameter D of the balance weight 301 meet the condition that: the diameter e of the central opening 303 is less than or equal to the minimum slewing diameter D of the balance weight 301, i.e., $e \leq D$.

By setting $e \leq D$, the diameter of the central opening 303 of the oil baffle shield 302 is smaller than the diameter of the inner wall surface of the balance weight 301, so that the air flow out of the central opening 303 between the mounting portion 305 of the oil baffle shield 302 and the balance weight 301 is reduced, and the effect of high pressure is ensured to be formed on the inner wall surface of the oil baffle shield 302, thereby increasing the throughput of the motor.

The compressor of the embodiment of the present disclosure includes the rotor assembly of the embodiment of the present disclosure. According to the compressor of the embodiment of the present disclosure, by adopting the rotor assembly of the embodiment according to the first aspect of the present disclosure, the flow rate of the vent hole 103 can be increased, thereby improving the oil return capacity of the air gap between the outer edge of the stator and the inner wall surface of the shell.

It should be noted that the compressor of the embodiment of the present disclosure may include a scroll compressor, a rolling rotor compressor and the like. The rolling rotor compressor belongs to one rotary compressor.

Figure 8:
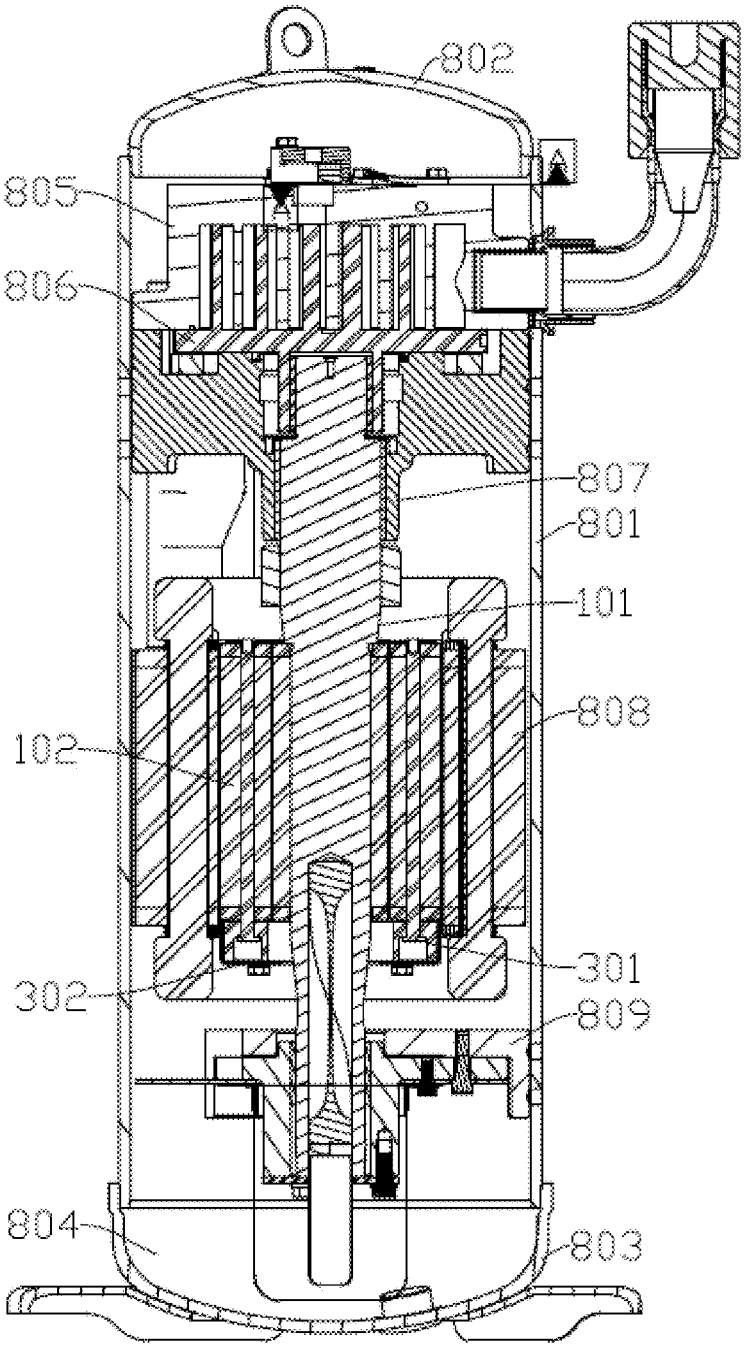
FIG. 8 is a cross-sectional view of a compressor according to an embodiment of the present disclosure.

With reference to FIG. 8, taking the scroll compressor as an example, the scroll compressor includes a shell, a compression assembly, a motor assembly, a crankshaft 101 (shaft portion) and other components.

The shell includes a cylinder 801, an upper cover 802 and a lower cover 803. The cylinder 801 is penetrated in the axial direction. The upper cover 802 is arranged on an upper portion of the cylinder 801 and fixed to the upper portion of the cylinder 801 by welding, for example. The lower cover 803 is arranged on a lower portion of the cylinder 801 and fixed to the lower portion of the cylinder 801 by welding, for example. In this way, the cylinder 801, the upper cover 802 and the lower cover 803 together form a closed mounting space. Components, such as the compressor assembly, the motor assembly, the crankshaft 101 and the like, are respectively mounted in the mounting space. The lower cover 803 of the shell is recessed downward, thereby forming an oil sump 804 for storing oil at the bottom portion of the shell.

The compression assembly is fixed in the shell. The compression assembly mainly includes a fixed scroll plate 805, a movable scroll plate 806 and a main frame 807. The fixed scroll plate 805 includes a fixed scroll plate body and spiral fixed scroll teeth extending from the fixed scroll plate body. The movable scroll plate 806 includes a movable scroll plate body and spiral movable scroll teeth extending from the movable scroll plate body. A compression cavity is formed by the mutual meshing of the fixed scroll teeth on the fixed scroll plate 805 and the movable scroll teeth on the movable scroll plate 806.

The fixed scroll plate body, the cylinder 801 of the shell and the upper cover 802 of the shell are enclosed together to form an exhaust cavity. The exhaust cavity is located above the fixed scroll plate body. In addition, the fixed scroll plate body is provided with an exhaust port and an air inlet. The exhaust port is communicated with the compression cavity and the exhaust cavity. The exhaust port may be arranged in a middle of an upper portion of the fixed scroll plate body. The exhaust port is used for discharging a high-pressure refrigerant in a high-pressure area of the compression cavity into the exhaust cavity. The air inlet is arranged at an edge of the fixed scroll plate body and used for communicating the compression cavity with an air suction pipe.

The main frame 807 is mounted at a lower portion of the movable scroll plate 806. The main frame 807, the fixed scroll plate 805 and movable scroll plate 806 together form a back-pressure chamber. In some examples, the back-pressure chamber is annularly arranged. The back-pressure chamber is filled with gas, which may be the refrigerant from the compression cavity or the gas provided by an external device of the scroll compressor. This gas provides a back pressure to the movable scroll plate body of the movable scroll plate 806, so that the movable scroll plate 806 and the fixed scroll plate 805 are hermetically abutted.

The motor assembly includes a stator assembly 808 and a rotor assembly. The stator assembly 808 is fixed on an inner wall surface of the cylinder 801 of the shell, and the rotor assembly is located in a middle portion of the stator assembly 808. The crankshaft 101 passes through a shaft hole in the middle portion of the rotor assembly and is fixed to the rotor assembly. When the scroll compressor is powered on, the stator assembly 808 drives the rotor assembly to rotate, and the crankshaft 101 rotates with the rotation of the rotor assembly.

In order to suppress axial displacement of the crankshaft 101 when rotating, a sub-frame 809 is mounted on the cylinder 801 below the motor assembly, and the sub-frame 809 is fixed to the cylinder 801 of the shell. A first end portion of the crankshaft 101 passes through the sub-frame 809 and extends toward the lower cover 803. In this way, the sub-frame 809 supports the crankshaft 101 in the radial direction of the crankshaft 101, thereby suppressing the jitter generated when the crankshaft 101 rotates.

A second end portion of the crankshaft 101 in the axial direction is in drive-connected to the lower portion of the movable scroll plate body. In this way, as the crankshaft 101 rotates, the movable scroll plate body is driven to perform eccentrically rotary motion. With the eccentrically rotary motion of the movable scroll plate body, the movable scroll teeth also perform eccentrically rotary motion at the same time. Therefore, relative positions of the movable scroll teeth on the movable scroll plate 806 and the fixed scroll teeth on the fixed scroll plate 805 are constantly changing, so that a size of the compression cavity is constantly changing, such that a low-pressure refrigerant in the compression cavity is compressed into a high-pressure refrigerant. The formed high-pressure refrigerant is discharged through an exhaust pipe of the scroll compressor, thereby providing a refrigerating medium for a refrigerating device.

The embodiments of the present disclosure are described in detail with reference to the drawings above, but the present disclosure is not limited to the above embodiments, and various changes may also be made within the knowledge scope of those of ordinary skills in the art without departing from the scope of the present disclosure.

The invention claimed is:

1. A rotor assembly applicable to a compressor, comprising:

a crankshaft;

a rotor core provided with a vent hole, wherein the vent hole extends through the rotor core along an axial direction of the rotor core;

a balance weight arranged at one end of the rotor core towards an oil sump of the compressor; and an oil baffle shield comprising an annular oil baffle portion with a circumferentially constant radial section geometry, wherein the oil baffle shield is configured to at least partially cover the balance weight and is provided with a central opening, wherein the crankshaft extends through the central opening with clearance to form a gap for refrigerant and oil to flow between the crankshaft and the central opening, wherein an accommodating space is defined between the oil baffle shield and the rotor core, and the accommodating space is communicated with the vent hole, the oil baffle shield configured to communicate a mixture of refrigerant and oil through the vent hole.

2. The rotor assembly according to claim 1, wherein the oil baffle shield comprises a mounting portion, the mounting portion is arranged at one end of the annular oil baffle portion away from the rotor core, and the mounting portion is connected to the balance weight.

3. The rotor assembly according to claim 2, wherein a minimum axial clearance between the annular oil baffle portion and the rotor core is no more than 0.5 mm.

4. The rotor assembly according to claim 2, wherein a minimum axial clearance between the annular oil baffle portion and the rotor core is no more than 0.1 mm.

5. The rotor assembly according to claim 2, wherein the mounting portion is fixed to the balance weight by bonding or a screw.

6. The rotor assembly according to claim 2, wherein:

an inner edge of the vent hole has a rotation diameter of d, the central opening has a diameter of e, a part of the crankshaft corresponding to the mounting portion has a diameter of f, and $e \geq d$, and $e \geq f+4$.

7. The rotor assembly according to claim 1, wherein:

the vent hole has a maximum inscribed circle; and the maximum inscribed circle of the vent hole has a diameter of no less than 3 mm.

8. The rotor assembly according to claim 1, wherein the rotor core is provided with a plurality of vent holes, and the plurality of vent holes are evenly distributed along a circumferential direction of the rotor core.

9. The rotor assembly according to claim 1, wherein a minimum turning diameter of the balance weight is D, a diameter of the central opening is e, and $e \leq D$.

10. A compressor comprising the rotor assembly according to claim 1.

11. The rotor assembly according to claim 1, wherein:

the annular oil baffle portion comprises one or more holes configured to secure the oil baffle shield to the balance weight; and the annular oil baffle portion is solid except for the holes.

* * * * *